US009231301B2

(12) United States Patent
Desclos et al.

(10) Patent No.: US 9,231,301 B2
(45) Date of Patent: Jan. 5, 2016

(54) MULTI-BAND MIMO ANTENNA

(71) Applicants: Laurent Desclos, San Diego, CA (US); Sebastian Rowson, San Diego, CA (US); Jeffrey Shamblin, San Marcos, CA (US); Young Cha, San Diego, CA (US)

(72) Inventors: Laurent Desclos, San Diego, CA (US); Sebastian Rowson, San Diego, CA (US); Jeffrey Shamblin, San Marcos, CA (US); Young Cha, San Diego, CA (US)

(73) Assignee: ETHERTRONICS, INC., San Diego, CA (US)

( * ) Notice: Subject to any disclaimer, the term of this patent is extended or adjusted under 35 U.S.C. 154(b) by 0 days.

(21) Appl. No.: 14/553,920

(22) Filed: Nov. 25, 2014

(65) Prior Publication Data

US 2015/0155621 A1 Jun. 4, 2015

Related U.S. Application Data

(60) Division of application No. 13/966,074, filed on Aug. 13, 2013, now Pat. No. 8,952,861, which is a division of application No. 13/548,221, filed on Jul. 13, 2012, now Pat. No. 8,542,158, which is a continuation-in-part of application No. 13/289,901, filed on Nov. 4, 2011, now Pat. No. 8,717,241, which is a continuation of application No. 12/894,052, filed on Sep. 29, 2010, now Pat. No. 8,077,116, which is a continuation of application No. 11/841,207, filed on Aug. 20, 2007, now Pat. No. 7,830,320.

(51) Int. Cl.

| | |
|---|---|
| ***H01Q 21/00*** | (2006.01) |
| ***H01Q 1/52*** | (2006.01) |
| ***H01Q 21/28*** | (2006.01) |
| ***H01Q 9/04*** | (2006.01) |

(52) U.S. Cl.
CPC ..... *H01Q 1/523* (2013.01); *H01Q 9/0442* (2013.01); *H01Q 21/28* (2013.01)

(58) Field of Classification Search
CPC ..... H01Q 21/28; H01Q 9/0442
USPC ..... 343/893, 702, 853, 858, 876
See application file for complete search history.

(56) References Cited

U.S. PATENT DOCUMENTS

| | | | | |
|---|---|---|---|---|
| 6,816,116 | B2 * | 11/2004 | Chen | 342/372 |
| 7,856,183 | B2 * | 12/2010 | Hinderthur et al. | 398/56 |
| 2008/0174508 | A1 * | 7/2008 | Iwai et al. | 343/850 |
| 2009/0196371 | A1 * | 8/2009 | Yamamoto et al. | 375/267 |
| 2010/0195753 | A1 * | 8/2010 | Yamamoto et al. | 375/267 |
| 2010/0295741 | A1 * | 11/2010 | Amari et al. | 343/702 |
| 2012/0306718 | A1 * | 12/2012 | Koyanagi et al. | 343/853 |

* cited by examiner

*Primary Examiner* — Hoanganh Le
(74) *Attorney, Agent, or Firm* — Coastal Patent Law Group, P.C.

(57) ABSTRACT

A multi-band antenna system for MIMO applications is adapted to provide high isolation between antennas across a wide range of frequencies. Multiple Isolated Magnetic Dipole (IMD) antennas are co-located and connected with a feed network that can include switches that adjust phase length for transmission lines connecting the antennas. Filtering is integrated into the feed network to improve rejection of unwanted frequencies. Filtering can also be implemented on the antenna structure. Either one or multi-port antennas can be used.

6 Claims, 9 Drawing Sheets

MULTI-BAND MIMO ANTENNA

CROSS-REFERENCE TO RELATED APPLICATIONS

This application is a divisional of U.S. patent application Ser. No. 13/966,074, filed Aug. 13, 2013, and titled "MULTI-BAND MIMO ANTENNA", now U.S. Pat. No. 8,952,861;

which is a divisional of U.S. patent application Ser. No. 13/548,221, filed Jul. 13, 2012, and titled "MULTI-BAND MIMO ANTENNA", now U.S. Pat. No. 8,542,158;

which is a CIP of U.S. patent application Ser. No. 13/548,211, filed Jul. 13, 2012, and titled "MULTI-FEED ANTENNA FOR PATH OPTIMIZATION", now U.S. Pat. No. 8,648,756;

which is a CIP of U.S. patent application Ser. No. 13/289,901, filed Nov. 4, 2011, and titled "ANTENNA WITH ACTIVE ELEMENTS", now U.S. Pat. No. 8,717,241;

which is a CON of U.S. patent application Ser. No. 12/894,052, filed Sep. 29, 2010, and also titled "ANTENNA WITH ACTIVE ELEMENTS", now U.S. Pat. No. 8,077,116;

which is a CON of U.S. patent application Ser. No. 11/841,207, filed Aug. 20, 2007, and also titled "ANTENNA WITH ACTIVE ELEMENTS", now U.S. Pat. No. 7,830,320;

the contents of each of which are hereby incorporated by reference.

BACKGROUND OF THE INVENTION

1. Field of the Invention

The present invention relates generally to the field of wireless communications and devices, and more particularly to the design of antennas configured for robust multiple band multi-input multi-output (MIMO) implementations for use in wireless communications.

2. Description of the Related Art

Commonly owned U.S. Pat. Nos. 7,339,531; 6,943,730; 6,919,857; 6,900,773; 6,859,175; 6,744,410; 6,323,810; and 6,515,634; describe an IMD antenna formed by coupling one element to another in a manner that forms a capacitively loaded inductive loop, setting up a magnetic dipole mode; the entire disclosures of which are hereby incorporated by reference. The magnetic dipole mode can also be generated by inducing a current mode onto a conductive element with specific slot geometry. This magnetic dipole mode provides a single or dual resonance and forms an antenna that is efficient and well isolated from the surrounding structure. This is, in effect, a self resonant structure that is de-coupled from the local environment. This antenna typically has a single feed for connection of the antenna to the transceiver. The IMD antenna is well isolated from the surrounding environment and two or more IMD antennas can be closely spaced and maintain high levels of isolation. This high isolation is a desired attribute for antennas directed toward multi-input multi-output (MIMO) implementations.

Current and future communication systems will require MIMO antenna systems capable of operation over multiple frequency bands. Isolation between adjacent elements as well as de-correlated radiation patterns will need to be maintained across multiple frequency bands, with antenna efficiency needing to be optimized for the antenna system.

SUMMARY OF THE INVENTION

Various embodiments of a multi-band antenna system are disclosed which provide high isolation between multiple antennas at two or more frequency bands. A transmission line network is described which optimizes isolation between antennas, and that incorporates filters, switches, and/or passive and active components to provide a fixed or dynamically tuned multi-antenna system. A beam steering feature is described capable of changing the radiation pattern of one or multiple antennas.

BRIEF DESCRIPTION OF THE DRAWINGS

Other advantages and characteristics of the invention will become apparent from the examples illustrated below pertaining to a hand-operated tool and methods for use therewith for which reference will be made to the attached figures, where.

DETAILED DESCRIPTION OF THE PREFERRED EMBODIMENTS

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

Figure 1:
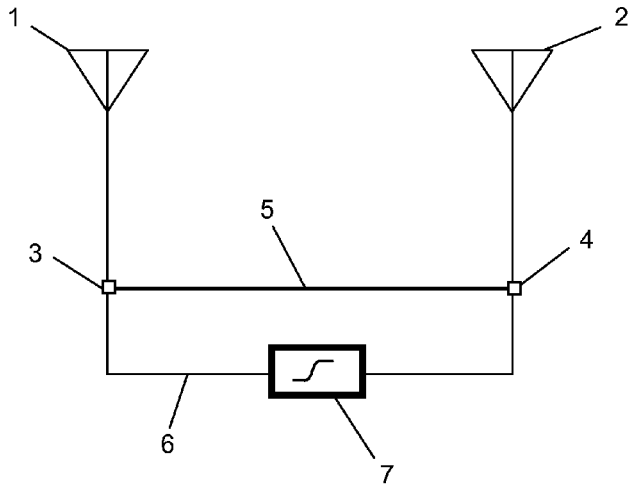
FIG. 1 illustrates a schematic of two antennas, the feed ports of the antennas being connected with two transmission lines, and a filter is located in the second transmission line.

In accordance with one embodiment, FIG. 1 illustrates an antenna system having two antenna elements 1, 2 with the feed ports 3, 4 of the antennas connected with two transmission lines 5 and 6. The two antenna elements can be referred to as a first antenna element 1 and a second antenna element 2, respectively. The electrical length of each transmission line is chosen to provide optimal isolation between the pair of antennas 1 and 2 at a specific frequency band. A filter 7 is incorporated in the second transmission line 6 to improve rejection of one or more frequencies.

Figure 2:
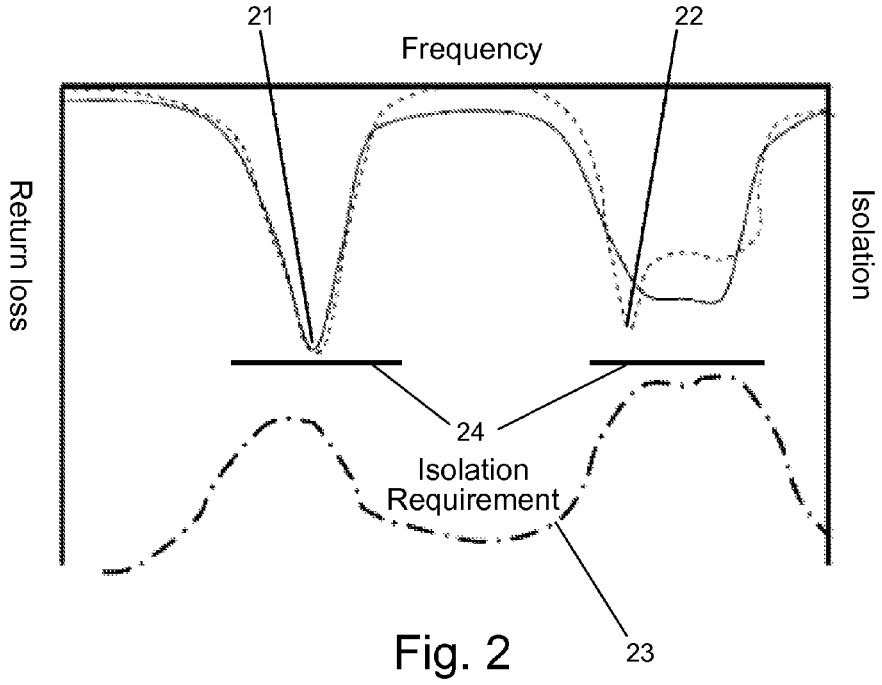
FIG. 2 illustrates a graph of the frequency response from the antenna system provided in FIG. 1, the graph illustrating both return loss and isolation.

FIG. 2 illustrates an example of the frequency response from the antenna system shown in FIG. 1. The electrical characteristics of transmission line 5 in FIG. 1 are optimized to provide good isolation between antennas 1 and 2 at the low frequency resonance 21. The electrical characteristics of transmission line 6 in FIG. 1 are optimized to provide good isolation between antennas 1 and 2 at the high frequency resonance 22. The isolation between antenna 1 and antenna 2 in FIG. 1 is shown by dotted line 23. The isolation at both low and high frequency resonance is below the solid lines 24 labeled "Isolation Requirement".

Figure 3:
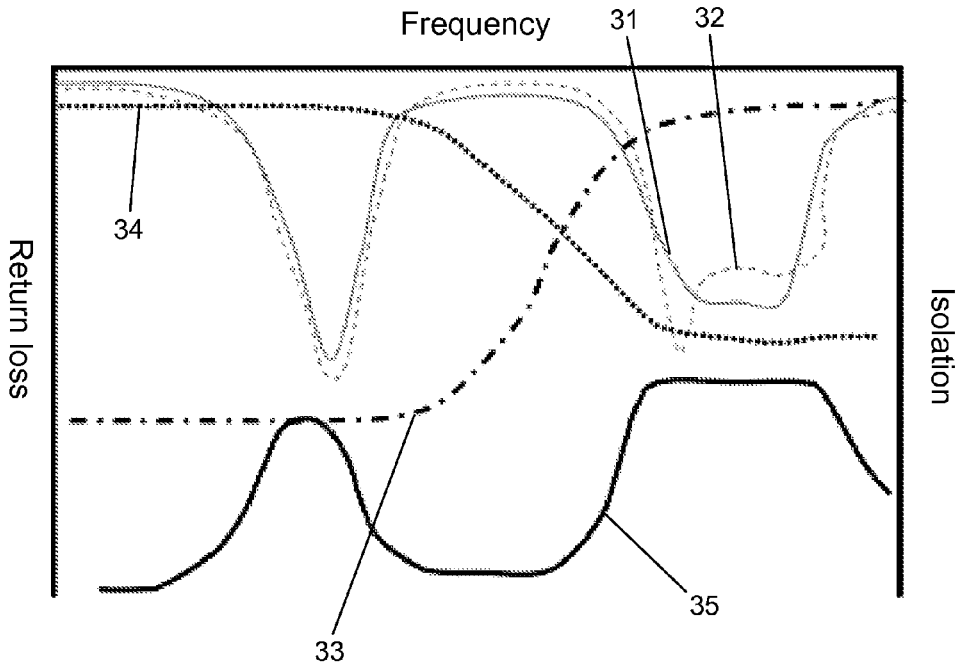
FIG. 3 illustrates the isolation provided between antenna 1 and antenna 2 of in FIG. 1, and the combination plot of the two transmission lines.

FIG. 3 shows a more detailed plot of the isolation between antenna 1 and antenna 2 as shown in FIG. 1. The plots of the return losses for antenna 1 and antenna 2 with low and high resonances are shown by lines 31 and 32, respectively. A plot of the isolation for antenna 1 is shown by dotted line 33. A plot of the isolation for antenna 2 is shown by dotted line 34. A combination of the transmission lines 1 and 2 provides good isolation at both low and high frequency resonances as shown by plot line 35.

Figure 4:
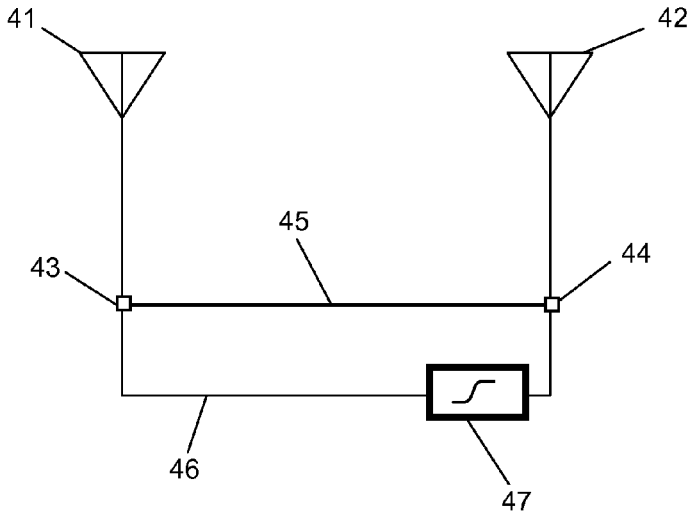
FIG. 4 illustrates a system having two antennas, the feed ports of the antennas being connected with two transmission lines, and a filter is located in the second transmission line. The location of the filter in the transmission line is used to optimize antenna system performance by improving isolation.

In accordance with another embodiment, FIG. 4 illustrates two antenna elements 41 and 42 with the feed ports 43 and 44 of the antennas connected with two transmission lines 45 and 46. The electrical length of each transmission line is chosen to provide optimal isolation between the pair of antennas 41 and 42 at a specific frequency band. The location of the filter 47 in the second transmission line is chosen to optimize antenna isolation by increasing or decreasing the distance between the filter 47 and the feed points 43 and 44 of the antenna. This feature provides a method to use the coupling between the transmission lines and coupling between the antennas and the transmission lines to optimize antenna system performance by improving isolation.

Figure 5:
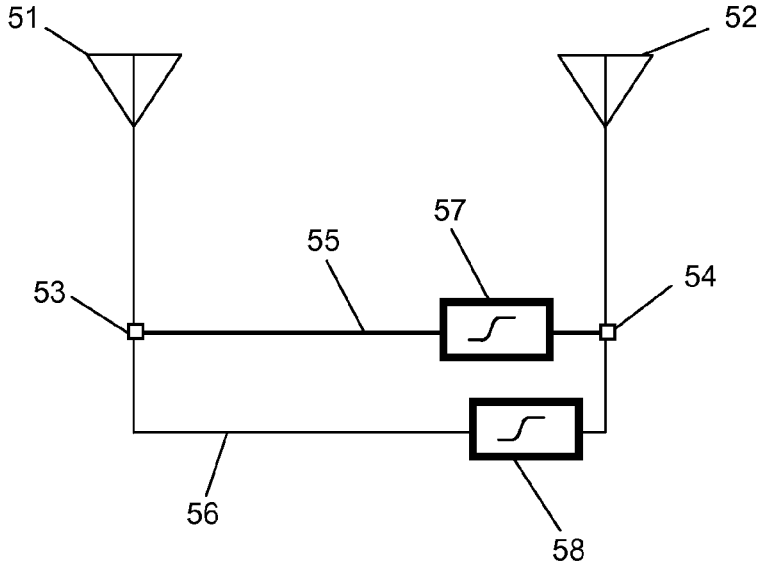
FIG. 5 illustrates a system having two antennas, the feed ports of the antennas connected with two transmission lines, and a filter is positioned in both transmission lines. The location of the filters in each of the transmission lines is configured to optimize antenna system performance by improving rejection at specific frequencies.
Figure 6:
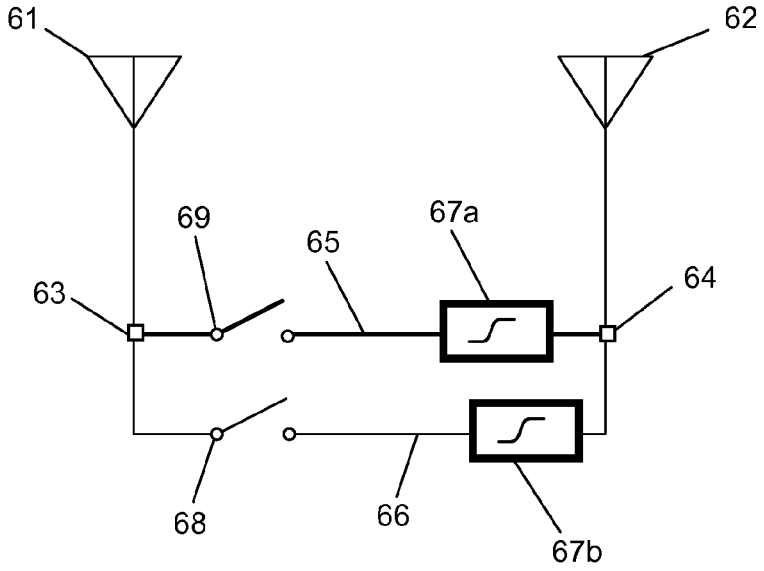
FIG. 6 illustrates an a system having two antennas, the feed ports of the antennas connected with two transmission lines, and a filter and switch are positioned in each of the transmission lines.

In accordance with another embodiment, FIG. 5 illustrates two antenna elements 51 and 52 with the feed ports 53 and 54 of the antennas connected with two transmission lines 55 and 56. The electrical length of each transmission line is chosen to provide optimal isolation between the pair of antennas at a specific frequency band. Filters 57 and 58 are incorporated into each transmission line to improve rejection of the frequencies that each transmission line is optimized for. The location of each filter is chosen to optimize antenna isolation by increasing or decreasing the distance between the filters and the feed points of the antenna. This feature provides a method to use the coupling between the transmission lines and coupling between the antennas and the transmission lines to optimize antenna system performance by improving isolation In accordance with another embodiment, FIG. 6 illustrates two antenna elements 61 and 62 with the feed ports 63 and 64 of the antennas connected with two transmission lines 65 and 66. The electrical length of each transmission line is chosen to provide optimal isolation between the pair of antennas at a specific frequency band. Filters 67*a* and 67*b* and switches 68 and 69 are incorporated into each respective transmission line. Filters 67*a* and 67*b* are used to improve rejection of the frequencies that each transmission line is optimized for. Switches 68 and 69 provide the ability to dynamically connect or disconnect the transmission line used to connect the antenna feed ports.

Figure 7:
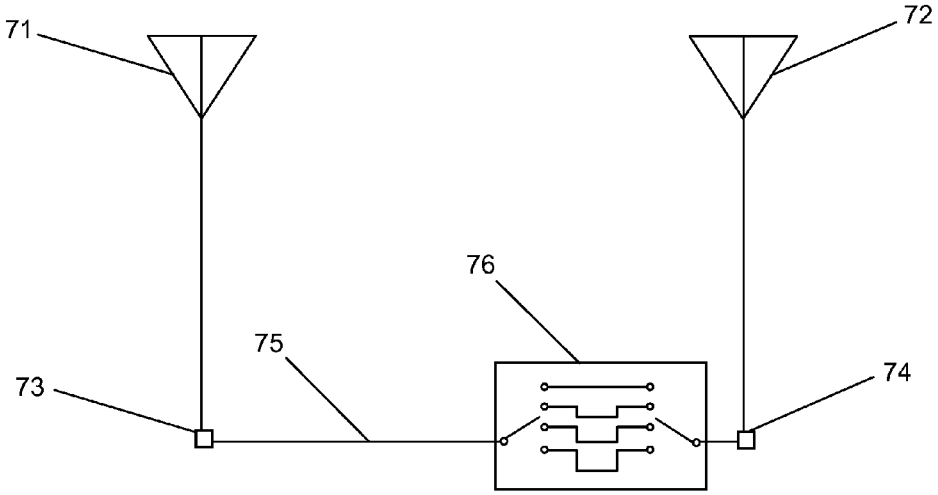
FIG. 7 illustrates a pair of antennas with the antenna feed ports connected by a single transmission line. The transmission line consists of a multi-port switch assembly comprising two four-port switches allowing the electrical length of the transmission line to be varied.

In accordance with another embodiment, FIG. 7 illustrates a pair of antenna elements 71 and 72 with the antenna feed ports 73 and 74 connected by a single transmission line 75. A multi-port switch assembly 76 comprising two four port switches with transmission lines connecting adjacent ports is incorporated into the transmission line. This provides the ability to switch in different selections of transmission line to vary the electrical length of the total feed network. The feed network includes the transmission line 75 connecting the two antennas 71 and 72 along with the multi-port switch assembly 76.

Figure 8:
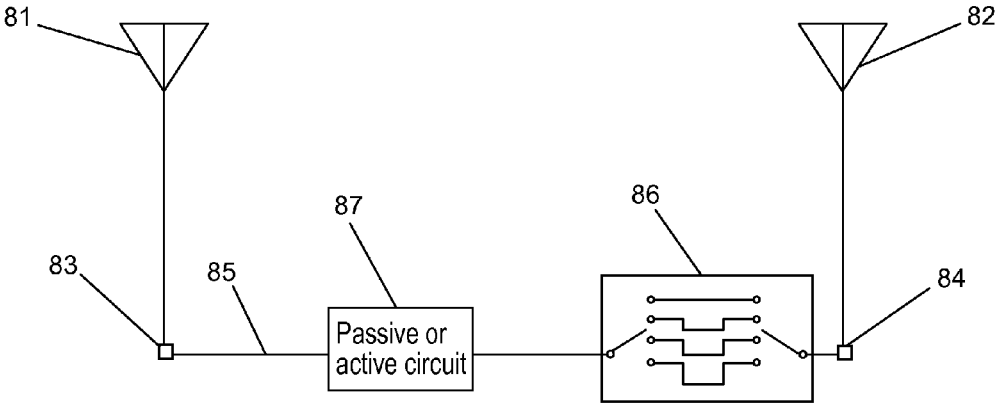
FIG. 8 illustrates a pair of antennas with the antenna feed ports connected by a single transmission line. The transmission line consists of a multi-port switch assembly comprising two four port switches in addition to a circuit for impedance matching in series with the with the four port switches.

In accordance with another embodiment, FIG. 8 illustrates a pair of antenna elements 81 and 82 with the antenna feed ports 83 and 84 connected by a single transmission line 85. A multi-port switch assembly 86 comprising two four port switches with transmission lines connecting adjacent ports is incorporated into the transmission line 85. This provides the ability to switch in different selections of transmission line to vary the electrical length of the total feed network, the feed network including the transmission line connecting the two antennas along with the multi-port switch assembly. A passive or active circuit 87 is attached in a series configuration to the switch assembly 86 and provides a method of adjusting the impedance match of the transmission line connecting the pair of antennas either statically for a passive circuit, or dynamically for an active circuit.

Figure 9:
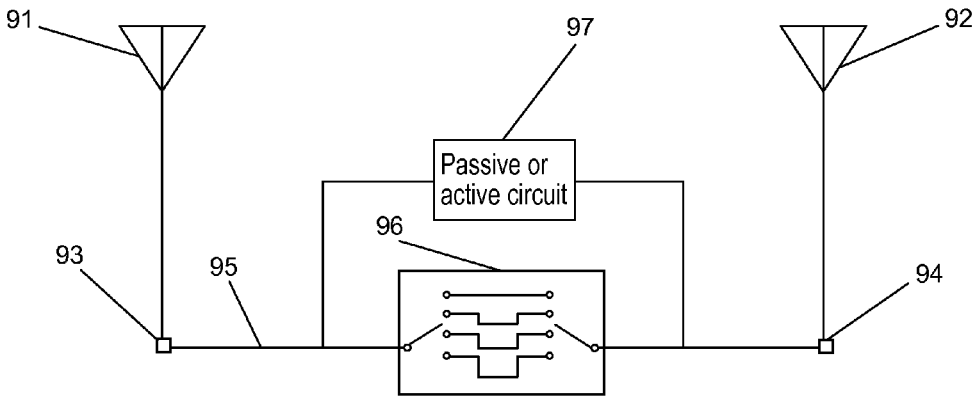
FIG. 9 illustrates a pair of antennas with the antenna feed ports connected by a single transmission line. The transmission line consists of a multi-port switch assembly comprising two four-port switches in addition to a circuit for impedance matching in parallel with the with the four-port switches.

In accordance with another embodiment, FIG. 9 illustrates a pair of antenna elements 91 and 92 with the antenna feed ports 93 and 94 connected by a single transmission line 95. A multi-port switch assembly 96 comprising two four port switches with transmission lines connecting adjacent ports is incorporated into the transmission line. This provides the ability to switch in different selections of transmission line to vary the electrical length of the total feed network, the feed network including the transmission connecting the two antennas along with the multi-port switch assembly. A passive or active circuit 97 is attached in a shunt configuration to the switch assembly 96 and provides a method of adjusting the impedance match of the transmission line connecting the pair of antennas either statically for a passive circuit, or dynamically for an active circuit.

Figure 10:
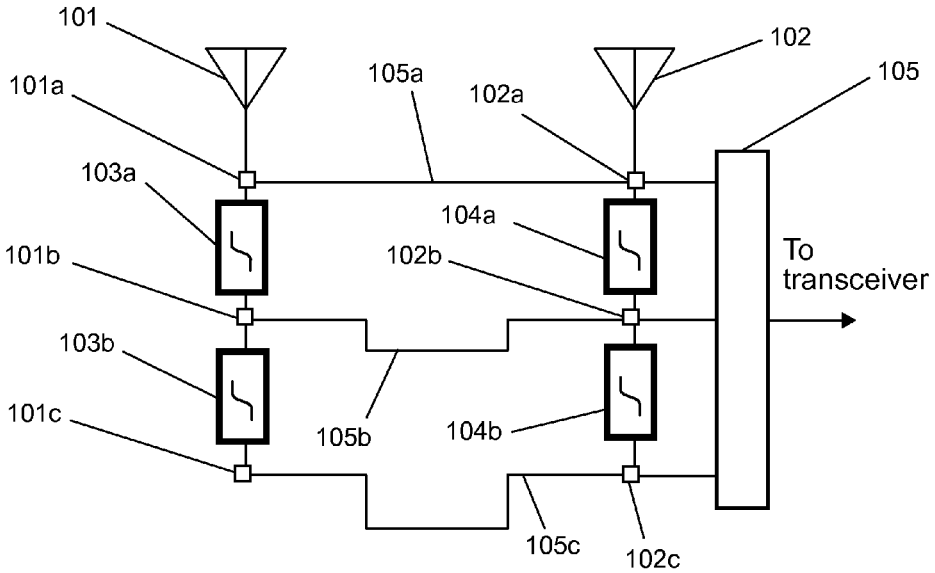
FIG. 10 illustrates an antenna system having two antennas, each with three feed ports and transmission lines connecting pairs of feed ports. Filters are incorporated into the antenna structures improve rejection of unwanted frequencies for the specific transmission lines. A combiner is used to combine the three feed ports into a single port for connection of the antenna to a transceiver or other component or subsystem.

In accordance with another embodiment, FIG. 10 illustrates a first antenna 101 with a first feed port 101*a*, a second feed port 101*b*, and a third feed port 101*c*, and a second antenna 102 with a fourth feed port 102*a*, a fifth feed port 102*b*, and a sixth feed port 102*c*. Transmission lines 104*a*, 104*b* and 104*c* are used to connect pairs of respective feed ports as illustrated. Filters 103*a*, 103*b*, 104*a* and 104*b* are incorporated into the antenna structures 101 and 102 to improve rejection of unwanted frequencies for the specific transmission lines. The electrical length of the transmission lines connecting pairs of antenna feed ports is chosen to provide optimal isolation between the pair of antennas at a specific frequency band. A combiner 105 is used to combine the three feed ports into a single port for connection of the antenna to a transceiver or other component or subsystem. For example, the schematic in this figure shows the high band response optimized with the electrical delay line L1 for frequency Fh. Filters 103*a* and 104*a* are low pass filters that pass frequencies below Fh. Filters 103*b* and 104*b* are low pass filters that pass frequencies below Fm. This schematic allows three separate frequency bands to be optimized simultaneously.

Figure 11A:
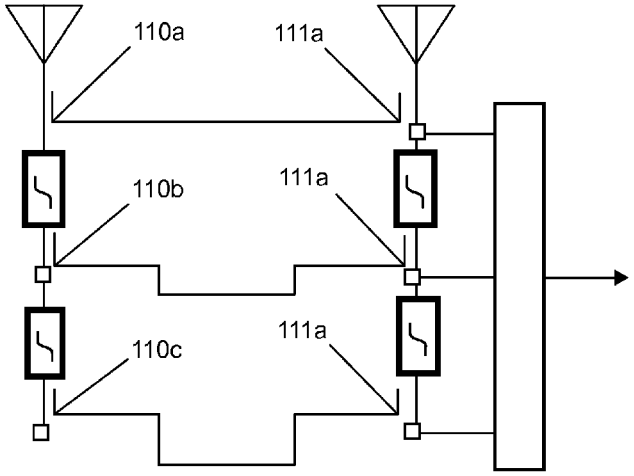
FIGS. 11(*a-c*) illustrate the antenna system configuration described in FIG. 10 with the exception that the feed ports of the antennas are capacitively coupled to the transmission lines. Two illustrations are shown of Isolated Magnetic Dipole (IMD) antennas with feed ports capacitively coupled to a region of the antenna by placing a second conductive element in close proximity to the main antenna element.
Figure 11B:
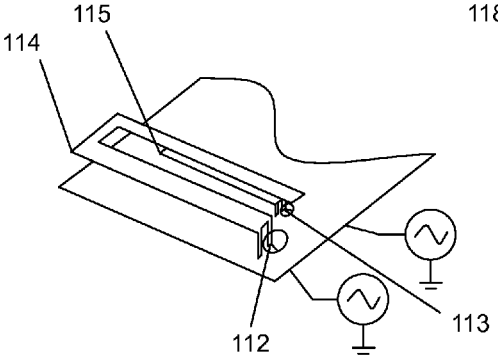
Figure 11C:
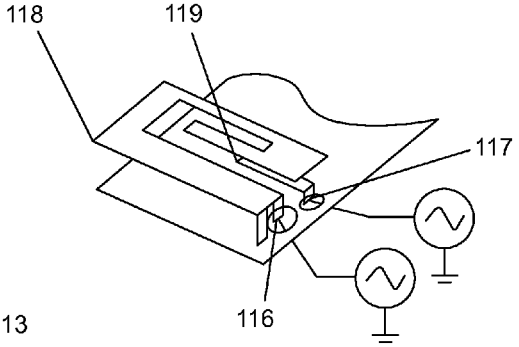

In accordance with another embodiment, FIG. 11(*a*) illustrates the antenna system configuration described in FIG. 10 with the exception that the feed ports of the antennas are capacitively coupled at points 110*a*, 110*b*, 110*c*, 111*a*, 111*b* and 111*c* to the transmission lines.

FIG. 11(*b*) illustrates an isolated magnetic dipole (IMD) antenna 114 with a feed port 112. A second element 115 is located below the IMD element providing an additional feed port 113 as a result of the coupling between the IMD antenna 112 and the second element 115. This structure creates a low band frequency resonance with two feed ports.

FIG. 11(*c*) illustrates an exemplary example of an isolated magnetic dipole (IMD) antenna 118 with a feed port 116. A second element 119 is located below the IMD element providing an additional feed port 117 as a result of the coupling between the IMD antenna 118 and the second element 119. This structure creates a high band frequency resonance with two feed ports.

Figure 12A:
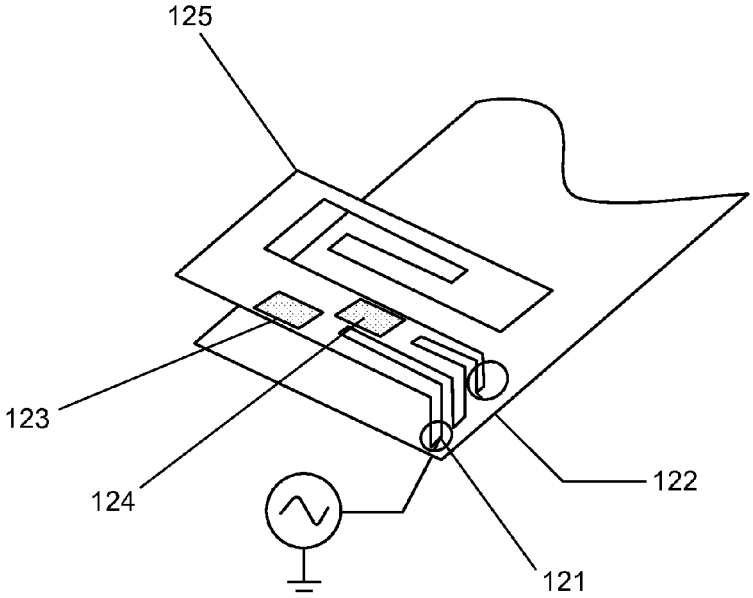
FIGS. 12(*a-b*) illustrate an isolated magnetic dipole (IMD) antenna with two feed ports and with filters integrated into the antenna element. The feed ports are connected to separate transceivers. Several types of conductive elements with distributed reactance incorporated into the element are shown.
Figure 12B:
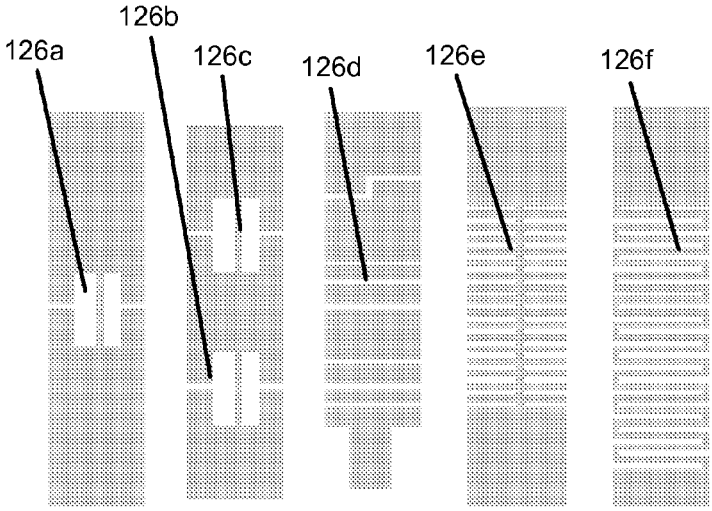

In accordance with another embodiment, FIG. 12 illustrates an isolated magnetic dipole (IMD) antenna 125 with two feed ports 121 and 122 and with filters 123 and 124 integrated into the antenna element 125. The feed ports 121 and 122 are connected to separate transceivers. Several types of conductive elements with distributed reactance incorporated into the element are shown. The distributed reactance can be adjusted to alter the frequency response of the conductive element. A distributed LC section 126*a* is designed into a conductive element. Two distributed LC sections 126*b* and 126*c* are designed into a single conductive element. A series of capacitive sections are formed by coupling regions 126*d* designed into a conductive element. A method to reduce the frequency of operation is shown in the design 126*e* incorporated into a conductive element. Another method of applying a distributed LC circuit is shown in pattern 126*f*.

Figure 13:
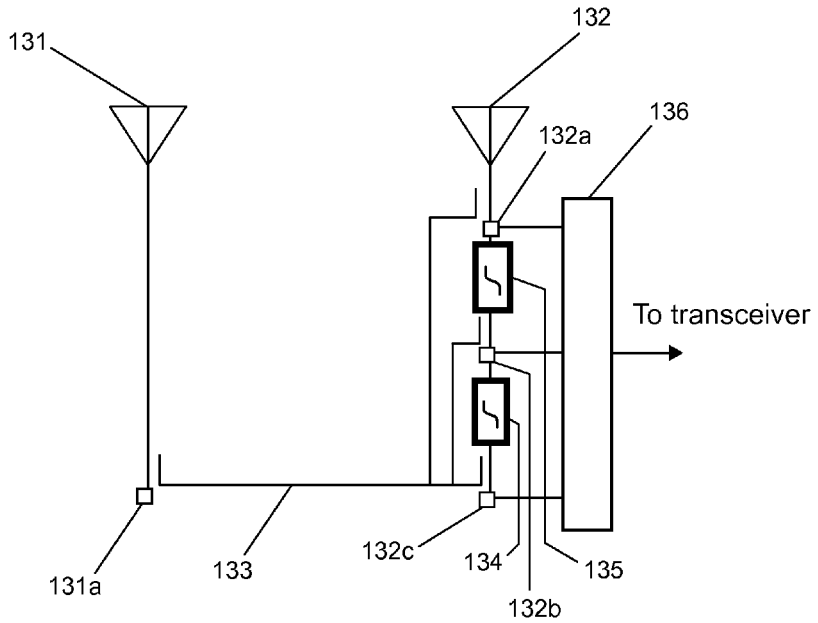
FIG. 13 illustrates an antenna system having two antennas with feed ports that are capacitively coupled to the transmission lines. Filters are incorporated into the second antenna to improve rejection of unwanted frequencies for the specific transmission lines. A combiner is used to combine some of the feed ports into a single port.

In accordance with another embodiment, FIG. 13 illustrates a pair of antennas, the first antenna 131 having a single feed port 131*a* and the second antenna 132 having three feed ports, 132*a*, 132*b*, and 132*c*. A transmission line 133 is used to connect the single feed port 131*a* of the first antenna to the three feed ports 132*a*, 132*b*, and 132*c* of the second antenna 132 using capacitive coupling. Filters 134 and 135 are incorporated into the antenna structure of the second antenna 132 to improve rejection of unwanted frequencies for the specific transmission lines. A combiner 136 is used to combine the three feed ports into a single port for connection of the antenna to a transceiver or other component or subsystem.

Figure 14A:
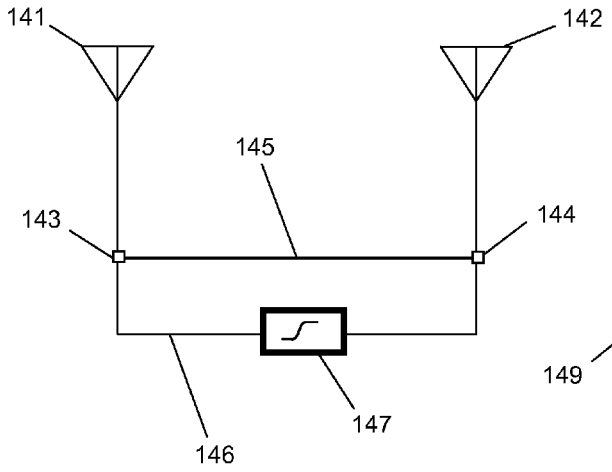
FIGS. 14(*a-b*) illustrate an antenna system having two antennas with the feed ports of the antennas connected with two transmission lines. The electrical length of each transmission line is chosen to provide optimal isolation between the pair of antennas at a specific frequency band. A filter is incorporated in the second transmission line to improve rejection of the frequencies that the second transmission line is optimized for. An additional element, a parasitic element, is connected to an active element and positioned in proximity to one or both antennas. The active tuning element can, for example, be any one or more of voltage controlled tunable capacitors, voltage controlled tunable phase shifters, FET's, switches, MEMs device, transistor, or circuit capable of exhibiting ON-OFF and/or actively controllable conductive/inductive characteristics.
Figure 14B:
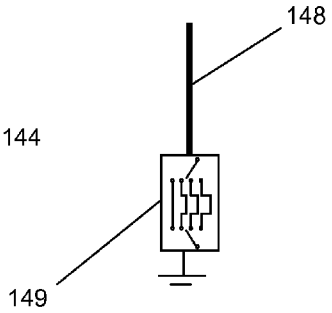
Figure 15A:
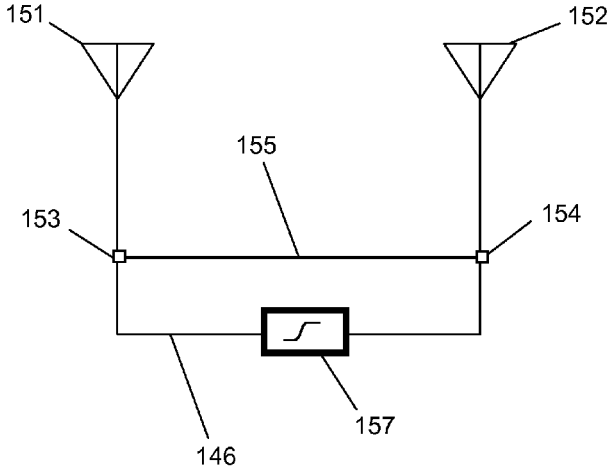
FIGS. 15(*a-d*) illustrate an antenna system having two antennas with the feed ports of the antennas connected with two transmission lines. The electrical length of each transmission line is chosen to provide optimal isolation between the pair of antennas at a specific frequency band. A filter is incorporated in the second transmission line to improve rejection of the frequencies that the second transmission line is optimized for. One or multiple additional elements with one or multiple active elements are positioned in proximity to one or both antennas. The active tuning elements can, for example, be any one or more of voltage controlled tunable capacitors, voltage controlled tunable phase shifters, FET's, switches, MEMs device, transistor, or circuit capable of exhibiting ON-OFF and/or actively controllable conductive/inductive characteristics.
Figure 15B:
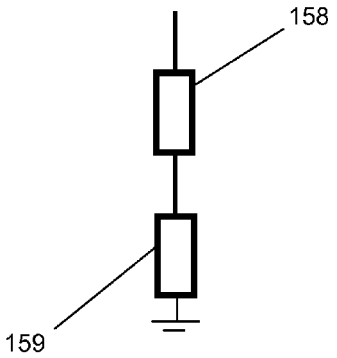
Figure 15C:
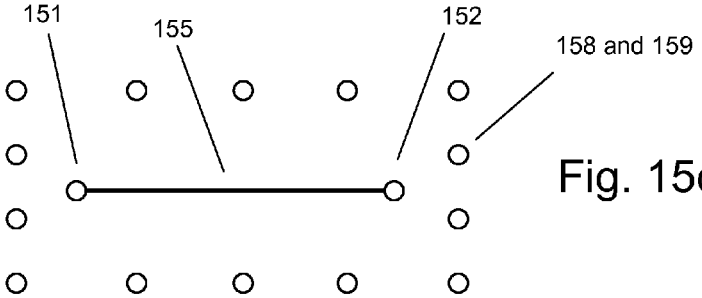
Figure 15D:
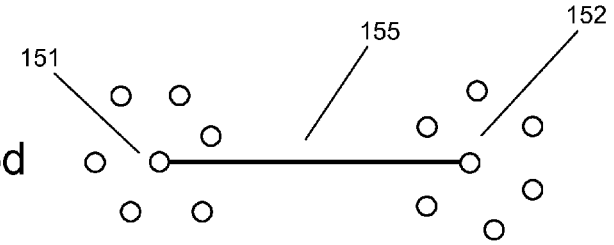

In accordance with another embodiment, FIG. 14 illustrates two antennas 141 and 142 with the feed ports 143 and 144 of the antennas connected with two transmission lines 145 and 146. The electrical length of each transmission line is chosen to provide optimal isolation between the pair of antennas at a specific frequency band. A filter 147 is incorporated in the second transmission line 146 to improve rejection of the frequencies that the first transmission line is optimized for. An additional element, a parasitic element 148, is connected to an active element 149 and positioned in proximity to one or both antennas. The active tuning element 149 can, for example, be any one or more of voltage controlled tunable capacitors, voltage controlled tunable phase shifters, FET's, switches, MEMs device, transistor, or circuit capable of exhibiting ON-OFF and/or actively controllable conductive/inductive characteristics. It should be further noted that coupling of the various active control elements to different antenna and/or parasitic elements may be accomplished in different ways. For example, active elements may be deposited generally within the feed area of the antenna and/or parasitic elements by electrically coupling one end of the active element to the feed line, and coupling the other end to the ground portion. This element is coupled to one or both antennas and will alter the radiation pattern of one or both antennas as the active element is transitioned from one reactance to a second, different reactance. The simplest method is to transition from an open to short condition to adjust the antenna beam position.

In yet another embodiment, FIG. 15 illustrates two antennas 151 and 152 with the feed ports 153 and 154 of the antennas connected with two transmission lines 155 and 156. The electrical length of each transmission line is chosen to provide optimal isolation between the pair of antennas at a specific frequency band. A filter 157 is incorporated in the second transmission line 156 to improve rejection of the frequencies that the second transmission line is optimized for. Two active elements 148 and 149 are attached to a parasitic element and positioned in proximity to one or both antennas. The active tuning elements 158 and 159 can, for example, be any one or more of voltage controlled tunable capacitors, voltage controlled tunable phase shifters, FET's, switches, MEMs device, transistor, or circuit capable of exhibiting ON-OFF and/or actively controllable conductive/inductive characteristics. This element is coupled to one or both antennas and will alter the radiation pattern of one or both antennas as the active element is transitioned from one reactance to a second, different reactance. The simplest method is to transition from an open to short condition to adjust the antenna beam position. The first top view illustrates multiple parasitic elements with active elements surrounding the two antennas. These parasitic elements provide the ability to alter the antenna beam position of one or both antennas. The second top view illustrates an alternate configuration for radiation pattern control.

The above examples are set forth for illustrative purposes and are not intended to limit the spirit and scope of the invention. One having skill in the art will recognize that deviations from the aforementioned examples can be created which substantially perform the same task and obtain similar results.

What is claimed is:

1. A multiband MIMO antenna system, comprising:

a first antenna element comprising a first feed port;

a second antenna element comprising a second feed port;

a first transmission line extending between said first and second feed ports;

said first transmission line further comprising a multi-port switch assembly having two or more switches and a plurality of transmission lines therebetween;

wherein said antenna system is adapted for optimized isolation between the first and second antenna elements.

2. The multiband MIMO antenna system of claim 1, wherein said multi-port switch assembly further comprises two four-port switches and a plurality of transmission lines connecting the ports of the two switches.

3. The multiband MIMO antenna system of claim 1, further comprising a passive circuit disposed in series to said multi-port switch assembly at said first transmission line, said passive circuit adapted for static impedance matching of the antennas.

4. The multiband MIMO antenna system of claim 1, further comprising an active circuit disposed in series with said multi-port switch assembly at said first transmission line, said active circuit adapted for active impedance matching of the antennas.

5. The multiband MIMO antenna system of claim 1, further comprising a passive circuit disposed in parallel connection said multi-port switch assembly at said first transmission line, said passive circuit adapted for static impedance matching of the antennas.

6. The multiband MIMO antenna system of claim 1, further comprising an active circuit disposed in parallel connection with said multi-port switch assembly at said first transmission line, said active circuit adapted for active impedance matching of the antennas.

* * * * *